US010859945B2

(12) United States Patent
Montfort et al.

(10) Patent No.: US 10,859,945 B2
(45) Date of Patent: Dec. 8, 2020

(54) CORNER TIE ATTACHMENT FOR A BAG LINER FOR RECEIVING A POWDER SUCH AS TONER

(71) Applicant: Xerox Corporation, Norwalk, CT (US)

(72) Inventors: David B. Montfort, Webster, NY (US); Edmund T. Varga, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/354,909

(22) Filed: Mar. 15, 2019

(65) Prior Publication Data

US 2020/0292962 A1 Sep. 17, 2020

(51) Int. Cl.
*G03G 15/08* (2006.01)

(52) U.S. Cl.
CPC ..... *G03G 15/0881* (2013.01); *G03G 15/0874* (2013.01); *G03G 15/0875* (2013.01); *G03G 2215/068* (2013.01); *G03G 2215/0682* (2013.01); *G03G 2215/0695* (2013.01)

(58) Field of Classification Search
CPC ..... B65D 88/1618; B65D 88/1625; B65D 88/1631; B65D 88/1668; B65D 88/1675; B65D 88/1681; G03G 15/0881
USPC ..... 383/111, 16, 22
See application file for complete search history.

(56) References Cited

U.S. PATENT DOCUMENTS 4,781,472 A * 11/1988 LaFleur ..... B65D 88/1618 383/105
5,192,134 A * 3/1993 Polett ..... B65D 88/1618 383/105
5,639,164 A * 6/1997 Ishino ..... B65D 90/046 220/1.5
5,810,478 A * 9/1998 LaFleur ..... B65D 88/1681 383/111
6,520,403 B1 * 2/2003 Lapoint, III ..... B65D 77/062 229/117.35
7,125,168 B2 * 10/2006 La Fleur ..... B65D 88/1618 383/111
7,594,581 B2 * 9/2009 Lapoint, III ..... B65D 5/3628 220/4.28

* cited by examiner

*Primary Examiner* — Derek J Battisti
(74) *Attorney, Agent, or Firm* — Simpson & Simpson, PLLC; Michael Nicholas Vranjes

(57) ABSTRACT

A tie attachment assembly, including a first layer including a first surface and a second surface, the first surface including an adhesive, a fold line, a second layer, including a third surface, a fourth surface connected to the first surface, a first cutout arranged on a first side of the fold line, and a second cutout arranged on a second side of the fold line, opposite the first side.

8 Claims, 7 Drawing Sheets

CORNER TIE ATTACHMENT FOR A BAG LINER FOR RECEIVING A POWDER SUCH AS TONER

FIELD

The present disclosure relates to the field of bag liners particularly useful for receiving a powdery substance, such as, for example, toner used in electrophotographic printing, and more particularly to tie attachment assemblies that secure liners to their respective bags.

BACKGROUND

Bags are often used for receiving powdery substances, such as, for example, toner used in electrophotographic printing, as well as other substances, such as wheat or grain, liquids, etc. Toner that is used in printing is loaded into bags for shipping and or storage. When fully loaded, the bags filled with toner can weigh approximately 253 kilograms. These bags often consist of a tough charge dissipative bag on the outside and an inner liner within the outer bag to contain the toner. The outer bags are often recyclable or reusable and the inner bags are secured to the outer bags at the eight corners, for example, using ties. The corners of the inner liner may comprise a flexible tie for attachment to the outer bag and may be held onto the corner using tape. Upon filling and emptying the inner liner, a great amount of stress is applied on the corner regions. Problems that are often seen with existing toner bag/liner assemblies due to this high stress include: tape pulling away from the inner liner or outer bag, ties untying, and liner ruptures and stress rips. Currently, the technical field is seeing between 1-2% failures due to small stress rips at the tape to liner interface. When these failures occur, toner is spilled and lost, labor is utilized to clean up the mess, and safety is jeopardized.

Thus, there is a long felt need for an improved tie attachment assembly that can adequately connect an inner liner to an outer bag while reducing or preventing failure of the components.

SUMMARY

According to aspects illustrated herein, there is provided a tie attachment assembly, comprising a first layer including a first surface and a second surface, the first surface comprising an adhesive, a fold line, a second layer, including a third surface, a fourth surface connected to the first surface, a first cutout arranged on a first side of the fold line, and a second cutout arranged on a second side of the fold line, opposite the first side.

According to aspects illustrated herein, there is provided a bag assembly, comprising an inner liner including a first corner formed from a first side and a second side, a tie attachment assembly, including a first layer including a first surface and a second surface, the first surface comprising an adhesive and arranged to be secured to the inner liner, a second layer, including a third surface arranged to abut against the inner liner proximate the first corner, a fourth surface connected to the first surface, a first cutout, and a second cutout, and a tie arranged between the third surface and the inner liner.

The present disclosure comprises a multi-laminate adhesive system including a high strength single sided adhesive tape and a precut engineered pattern label, designed to confine adhesion regions to specific locations to reduce stress concentration zones.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 1:
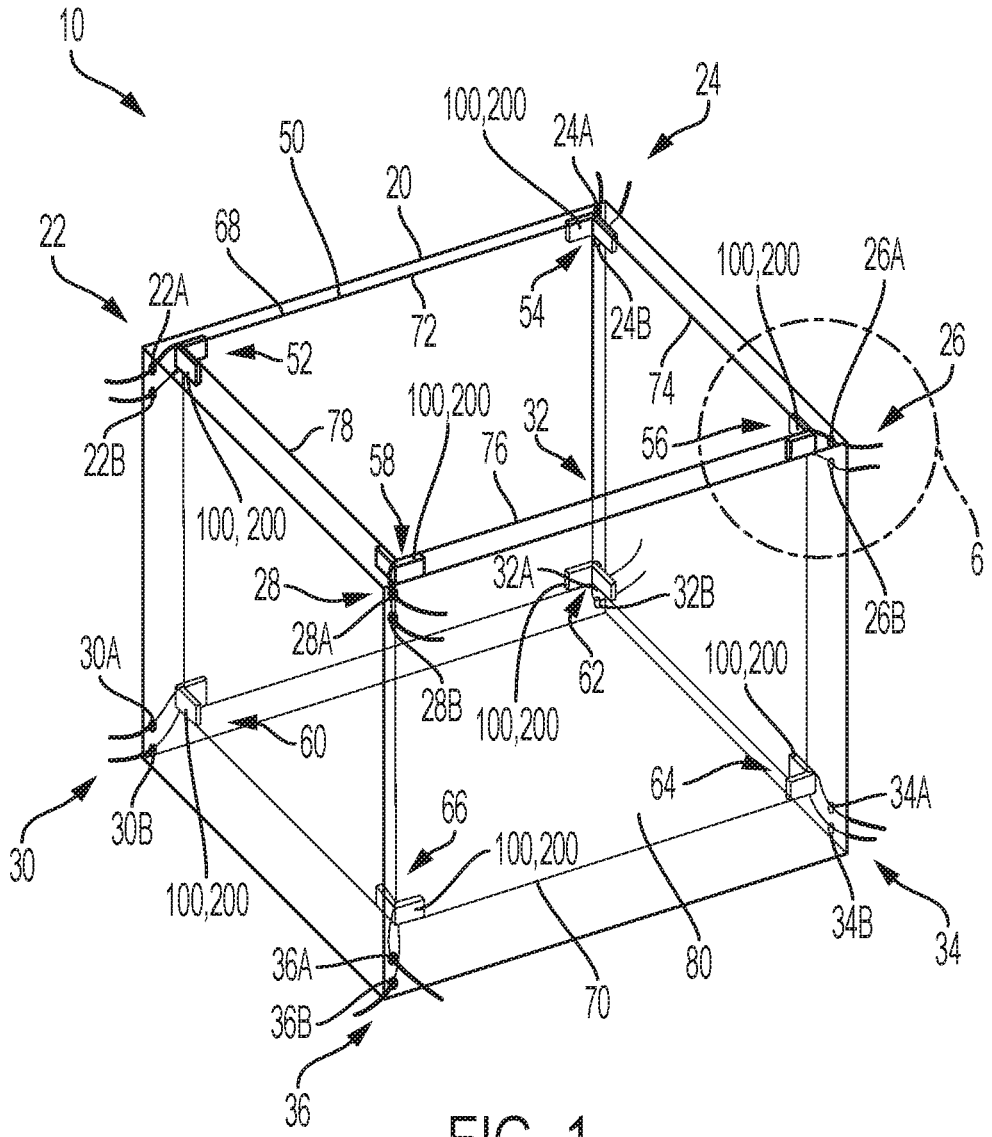
FIG. 1 is a perspective view of a bag assembly.

Referring now to the figures, FIG. 1 is a perspective view of a bag assembly 10. Bag assembly 10 generally comprises outer bag 20, inner liner 50, and one or more tie attachment assemblies 100, 200.

Outer bag 20 is generally rectangular or cubic in shape and comprises eight corners, or corners 22, 24, 26, 28, 30, 32, 34, and 36. Outer bag 20 generally comprises a charge dissipative material such that static and the like does not contribute to the clumping of the powdery substance (e.g., toner used in electrophotographic printing) arranged within inner liner 50. Each of the corners of outer bag 20 comprises at least one hole, through which the tie of tie attachment assemblies 100 and 200 extends, as will be discussed in greater detail below. In an example embodiment, each of the corners of outer bag 20 comprises two holes; however, it should be appreciated that each of the corners of outer bag 20 may comprise any number of holes suitable for connecting inner liner 50 to outer bag 20. In an example embodiment, corner 22 comprises holes 22A-B, corner 24 comprises holes 24A-B, corner 26 comprises holes 26A-B, corner 28 comprises holes 28A-B, corner 30 comprises holes 30A-B, corner 32 comprises holes 32A-B, corner 34 comprises holes 34A-B, and corner 36 comprises holes 36A-B. It should be appreciated that the holes of outer bag 20 are arranged proximate their respective corner. In an example embodiment, each of the corners of outer bag 20 comprise only one hole, and the ends of the tie of tie attachment assembly extend through the one hole and are secured to outer bag 20 using a clip which abuts against the outside of outer bag 20. Outer bag 20 is operatively arranged to be recyclable and reused with a plurality of disposable inner liners. It should be appreciated that, although the respective pairs of holes of each corner are shown on separate respective sides of outer bag 20, they may be arranged on the same side as an adjacent pair of holes. For example, holes 22A-B may be arranged on the same side of outer bag 20 as holes 28A-B.

Inner liner 50 is generally rectangular or cubic in shape and comprises eight corners, or corners 52, 54, 56, 58, 60, 62, 64, and 66. Inner liner 50 is arranged to be at least partially surrounded and/or enclosed by outer bag 20. Furthermore, inner liner 50 is arranged to be connected to outer bag 20 at each of the respective corners. In an example embodiment, inner liner 50 is arranged to be removeably connected to outer bag 20. For example, corner 52 is connected to corner 22, corner 54 is connected to corner 24, corner 56 is connected to corner 26, corner 58 is connected to corner 28, corner 60 is connected to corner 30, corner 62 is connected to corner 32, corner 64 is connected to corner 34, and corner 66 is connected to corner 36. Inner liner 50 comprises sides 72, 74, 76, 78, and 80, top edge 68 and bottom edge 70.

One or more tie attachment assemblies 100, 200 are connected to inner liner 50 generally proximate corners 52, 54, 56, 58, 60, 62, 64, and 66. In some embodiments, tie attachment assemblies 100, 200 are connected to inner liner 50 generally proximate corners 52, 54, 56, 58, 60, 62, 64, and 66 and abutting top edge 68 and bottom edge 70. The respective tie 160, 260 of tie attachment assembly 100, 200, respectively, extends through the pair of holes in the respective corner of outer bag 20 and secures inner liner 50 to outer bag 20, as will be discussed in greater detail below. In some embodiments, tie attachment assemblies 100, 200 are fixedly secured to inner liner 50. In some embodiments, tie attachment assemblies 100, 200 are removably secured to inner liner 50.

Figure 2:
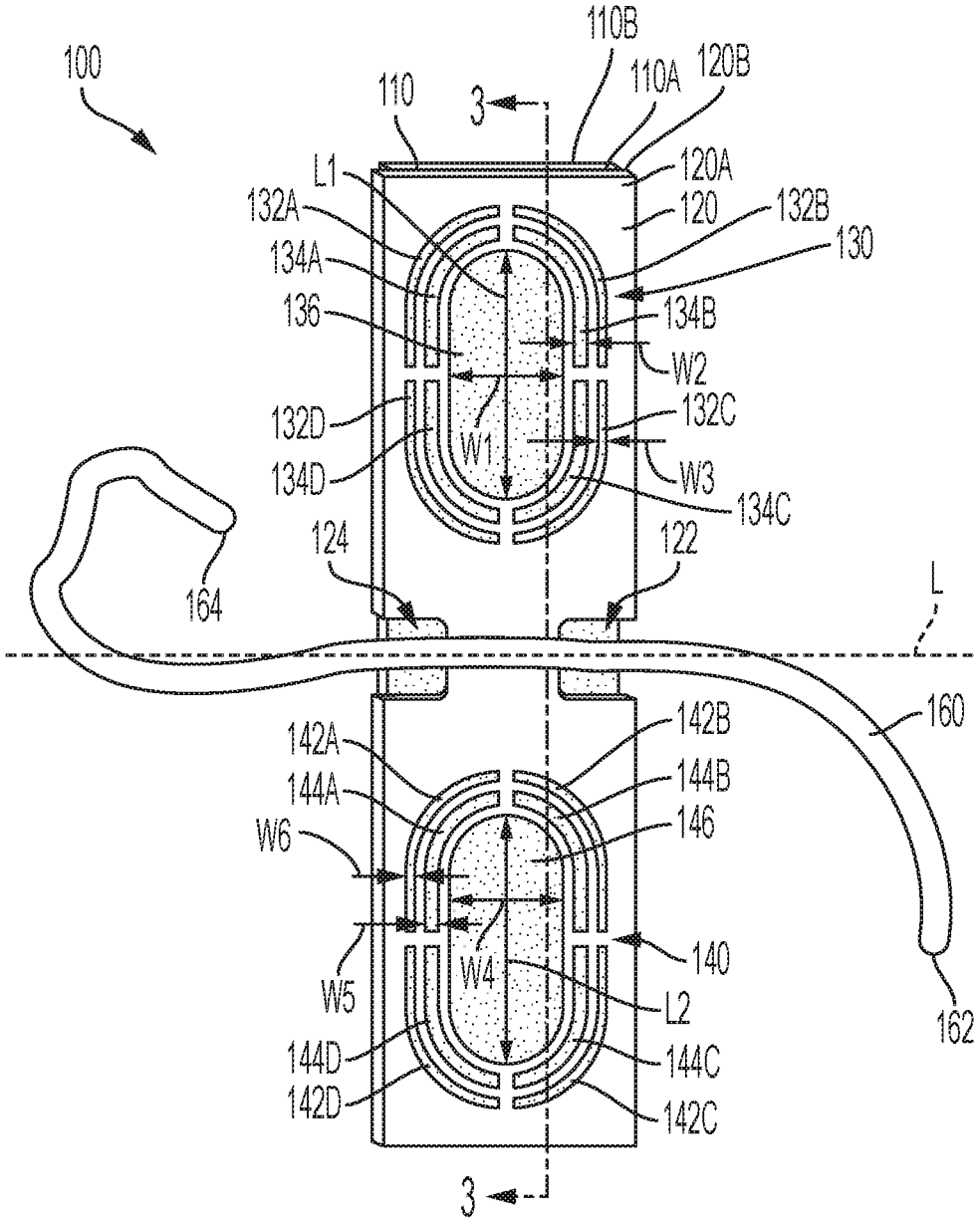
FIG. 2 is a perspective view of a tie attachment assembly.
Figure 3:
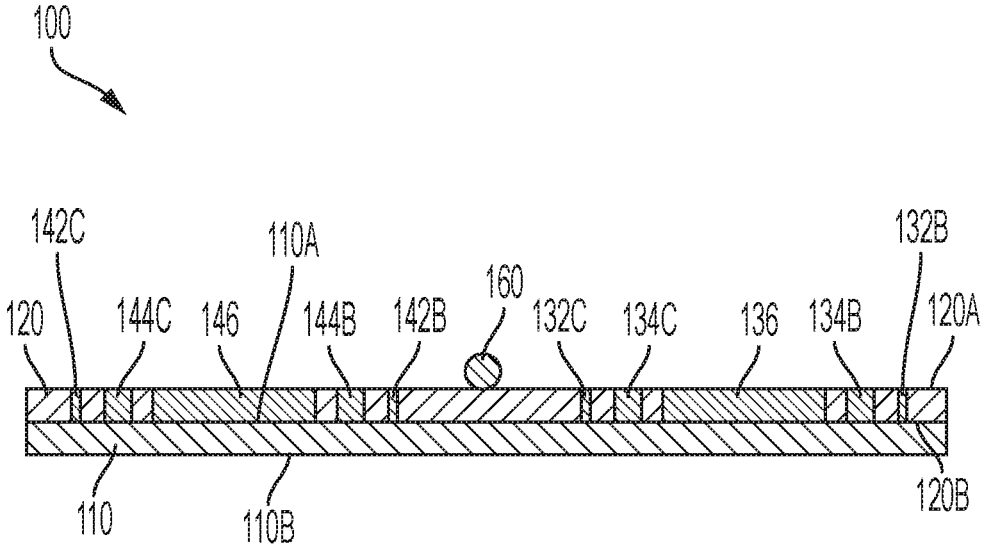
FIG. 3 is a cross-sectional view of the tie attachment assembly taken generally along line 3-3 in FIG. 2.

FIG. 2 is a perspective view of tie attachment assembly 100. FIG. 3 is a cross-sectional view of tie attachment assembly 100 taken generally along line 3-3 in FIG. 2. Tie attachment assembly 100 generally comprises layer 110, layer 120, and tie 160.

Layer 110 comprises surface 110A and surface 110B. Surface 110A is an adhesive surface and surface 110B is a non-adhesive surface. In some embodiments, layer 110 comprises one sided tape. In some embodiments, surface 110B comprises a non-stick substrate such that, when layered or rolled, the adhesive portions of tie attachment assembly 100 may be peeled away from surface 110B, as will be discussed in greater detail below. Surface 110A is arranged to abut, at least partially, against the outer surface of inner liner 50, as well as be connected to surface 120B of layer 120.

Layer 120 comprises surface 120A and surface 120B. Layer 120 is generally a thin film or non-adhering substrate operatively arranged to confine adhesive sections to a specific arrangement. Surface 120B layer 120 is connected to surface 110A of adhesive layer 110. Surface 120B is arranged to abut against the outer surface of inner liner 50. Layer 120 further comprises cutouts 122, 124, 130, and 140, which are operatively arranged to expose the adhesive surface 110A of layer 110. Cutouts 122 and 124 are arranged proximate fold line L. Cutouts 122 and 124 are arranged to maintain the position of tie 160 at or proximate to line L.

Cutout 130 comprises a generally oblong or an ellipse or ovular shape. Cutout 130 comprises radially outermost sections 132A-D, radially intermediate sections 134A-D, and central section 136. Sections 132A, 132B, 132C, 132D, 134A, 134B, 134C, 134D, and 136 are separated. In some embodiments, sections 132A-D are all connected and form one radially outermost section. In some embodiments, sections 134A-D are all connected and form one radially intermediate section. As shown, sections 132A-D comprise thickness or width W3, sections 134A-D comprises thickness or width W2, and section 136 comprises width W1 and length L1. In the embodiment shown, width W1 is greater than width W2, and width W2 is greater than W3. The sections of adhesive surface 110A that are exposed through layer 120 via cutout 130, more specifically via sections 132A-D, 134A-D, and 136, are arranged to be secured to the outer layer of inner liner 50 proximate the respective corner thereon. For example, fold line L will be positioned at the corner of inner liner 50, with cutout 130 being connected to a first side of inner liner 50 and cutout 140 being connected to a second side of inner liner 50, adjacent to the first side.

Cutout 140 comprises a generally oblong or an ellipse or ovular shape and is substantially similar to cutout 130. Cutout 140 comprises radially outermost sections 142A-D, radially intermediate sections 144A-D, and central section 146. Sections 142A, 142B, 142C, 142D, 144A, 144B, 144C, 144D, and 146 are separated. In some embodiments, sections 142A-D are all connected and form one radially outermost section. In some embodiments, sections 144A-D are all connected and form one radially intermediate section.

As shown, sections 142A-D comprise thickness or width W6, sections 144A-D comprises thickness or width W5, and section 146 comprises width W4 and length L2. In the embodiment shown, width W4 is greater than width W5, and width W5 is greater than W6. In some embodiments, width W4 is substantially equal to width W1, width W5 is substantially equal to width W2, width W6 is substantially equal to width W3, and length L2 is substantially equal to length L1. The sections of adhesive surface 110A that are exposed through layer 120 via cutout 130, more specifically via sections 132A-D, 134A-D, and 136, are arranged to be secured to the outer layer of inner liner 50 proximate the respective corner thereon. For example, fold line L will be positioned at the corner of inner liner 50, with cutout 130 being connected to a first side of inner liner 50 and cutout 140 being connected to a second side of inner liner 50, adjacent to the first side.

Tie 160 comprises end 162 and end 164. As shown, tie 160 is arranged on surface 120A of layer 120 and surface 110A of layer 110 (via cutouts 122 and 124), proximate fold line L. Cutouts 122 and 124 allow interaction between adhesive surface 110A and tie 160 to maintain the position of tie 160 proximate line L. When tie attachment assembly 100 is secured to inner liner 50, tie 160 is trapped between layer 120 and inner liner 50, thereby securing tie 160 to inner liner 50. In an example embodiment, layer 120 is wrapped completely around tie 160 such that tie 160 never comes into contact with inner liner 50. Ends 162 and 164 are then extended through the pair of holes of the respective corner of outer bag 20 and, for example, tied together to secure inner liner 50 to outer bag 20. To remove inner liner 50 from outer bag 20, ends 162 and 164 are untied or tie 160 is cut.

The purpose of the unique design of cutouts 130 and 140 is to reduce stress concentration zones on inner liner 50 when it is being filled with and emptied of a powdery substance (e.g., toner used in electrophotographic printing) or any other substance, such as wheat or grain, liquids, etc., and prevent or reduce rips, tears, or other failure of inner liner 50. As inner liner 50 is, for example, being filled with a substance, tension is applied to tie 160 and causes stress on inner liner 50 where tie attachment assembly is secured thereto. Tie attachment assembly 100 minimizes this stress and reduces tears and failure of inner liner 50.

Figure 4:
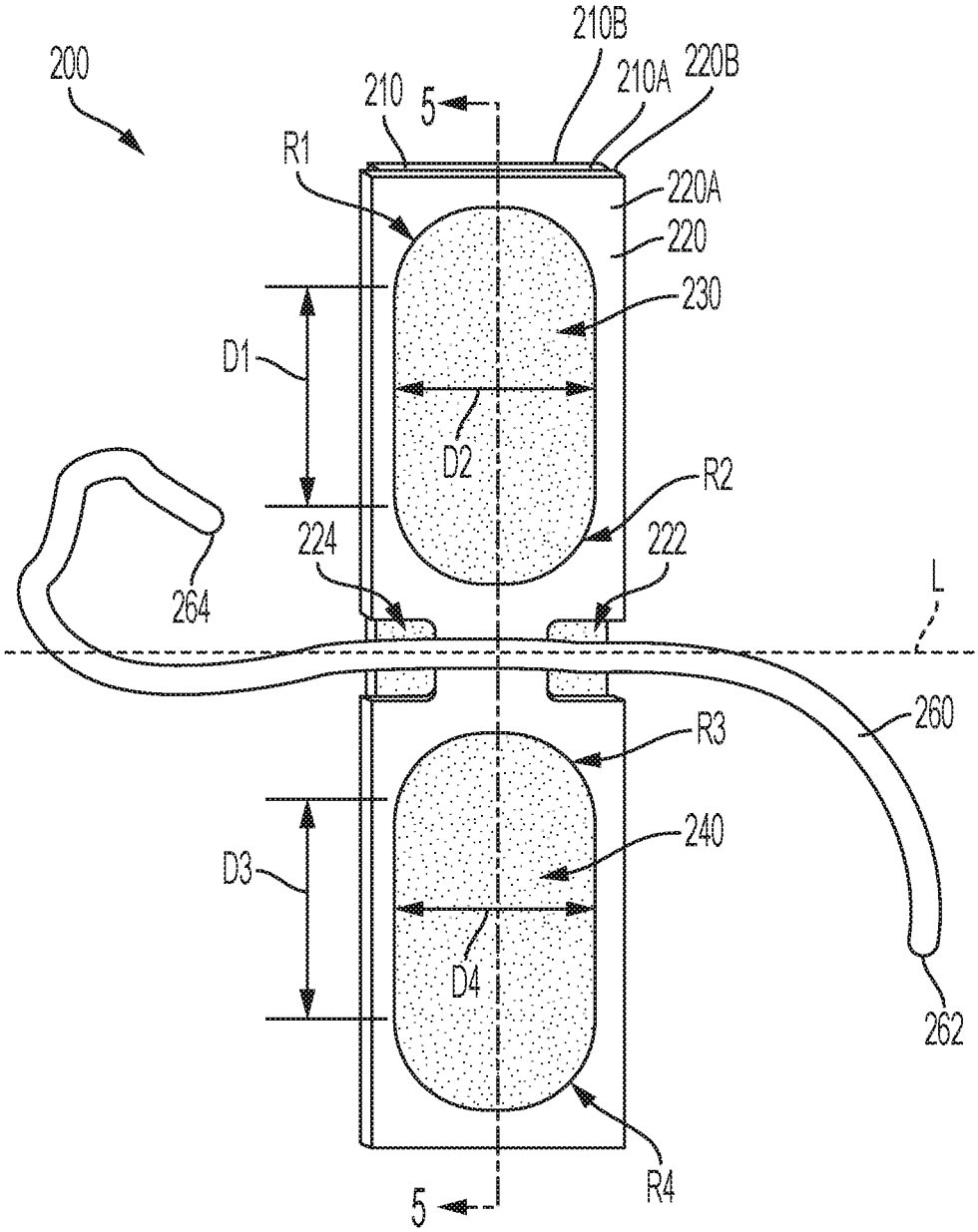
FIG. 4 is a perspective view of a tie attachment assembly.
Figure 5:
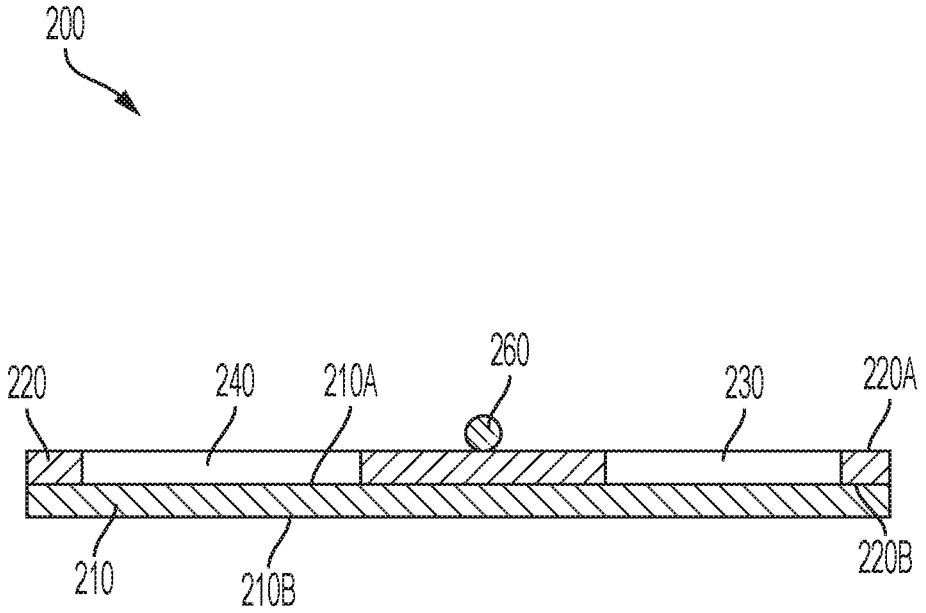
FIG. 5 is a cross-sectional view of the tie attachment assembly taken generally along line 5-5 in FIG. 4.

FIG. 4 is a perspective view of tie attachment assembly 200. FIG. 5 is a cross-sectional view of tie attachment assembly 200 taken generally along line 5-5 in FIG. 4. Tie attachment assembly 200 generally comprises layer 210, layer 220, and tie 260.

Layer 210 comprises surface 210A and surface 210B. Surface 210A is an adhesive surface and surface 210B is a non-adhesive surface. In some embodiments, layer 210 comprises one sided tape. In some embodiments, surface 210B comprises a non-stick substrate such that, when layered or rolled, the adhesive portions of tie attachment assembly 200 may be peeled away from surface 210B, as will be discussed in greater detail below. Surface 210A is arranged to abut, at least partially, against the outer surface of inner liner 50, as well as be connected to surface 220B of layer 220.

Layer 220 comprises surface 220A and surface 220B. Layer 220 is generally a thin film or non-adhering substrate operatively arranged to confine adhesive sections to a specific arrangement. Surface 220B layer 220 is connected to surface 210A of adhesive layer 210. Surface 220B is arranged to abut against the outer surface of inner liner 50. Layer 220 further comprises cutouts 222, 224, 230, and 240, which are operatively arranged to expose adhesive surface 210A of layer 210. Cutouts 222 and 224 are arranged proximate fold line L. Cutouts 222 and 224 are arranged to maintain the position of tie 260 at or proximate to line L.

Cutout 230 comprises a generally oblong or an ellipse or ovular shape. As shown, cutout 230 comprises distance D1, distance D2, radius R1, and radius R2. In the embodiments shown, distance D1 is greater than distance D2 and radius R2 is substantially similar to radius R1. The section of adhesive surface 210A that is exposed through layer 220 via cutout 230 is arranged to be secured to the outer layer of inner liner 50 proximate the respective corner thereon. For example, fold line L will be positioned at the corner of inner liner 50, with cutout 230 being connected to a first side of inner liner 50 and cutout 240 being connected to a second side of inner liner 50, adjacent to the first side.

Cutout 240 comprises a generally oblong or an ellipse or ovular shape and is substantially similar to cutout 230. As shown, cutout 240 comprises distance D3, distance D4, radius R3, and radius R4. In the embodiments shown, distance D3 is greater than distance D4 and radius R4 is substantially similar to radius R3. The section of adhesive surface 210A that is exposed through layer 220 via cutout 230 is arranged to be secured to the outer layer of inner liner 50 proximate the respective corner thereon. For example, fold line L will be positioned at the corner of inner liner 50, with cutout 230 being connected to a first side of inner liner 50 and cutout 240 being connected to a second side of inner liner 50, adjacent to the first side. In some embodiments, distance D3 is substantially equal to distance D1, distance D4 is substantially equal to distance D2, radius R3 is substantially equal to radius R1, and radius R4 is substantially equal to radius R2.

Tie 260 comprises end 262 and end 264. As shown, tie 260 is arranged on surface 220A of layer 220 and surface 210A of layer 210 (via cutouts 222 and 224), proximate fold line L. Cutouts 222 and 224 allow interaction between adhesive surface 210A and tie 260 to maintain the position of tie 260 proximate line L. When tie attachment assembly 200 is secured to inner liner 50, tie 260 is trapped between layer 220 and inner liner 50, thereby securing tie 260 to inner liner 50. In an example embodiment, layer 220 is wrapped completely around tie 260 such that tie 260 never comes into contact with inner liner 50. Ends 262 and 264 are then extended through the pair of holes of the respective corner of outer bag 20 and, for example, tied together to secure inner liner 50 to outer bag 20. To remove inner liner 50 from outer bag 20, ends 262 and 264 are untied or tie 260 is cut.

The purpose of the unique design of cutouts 230 and 240 is to reduce stress concentration zones on inner liner 50 when it is being filled with and emptied of a powdery substance (e.g., toner used in electrophotographic printing) or any other substance, such as wheat or grain, liquids, etc., and prevent or reduce rips, tears, or other failure of inner liner 50. As inner liner 50 is, for example, being filled with a substance, tension is applied to tie 260 and causes stress on inner liner 50 where tie attachment assembly is secured thereto. Tie attachment assembly 200 minimizes this stress and reduces tears and failure of inner liner 50. It should be appreciated that cutouts 130 and 140 and 230 and 240 do not need to be identical or substantially similar. In some embodiments, a tie attachment assembly comprises cutout 130 and 240.

Figure 6:
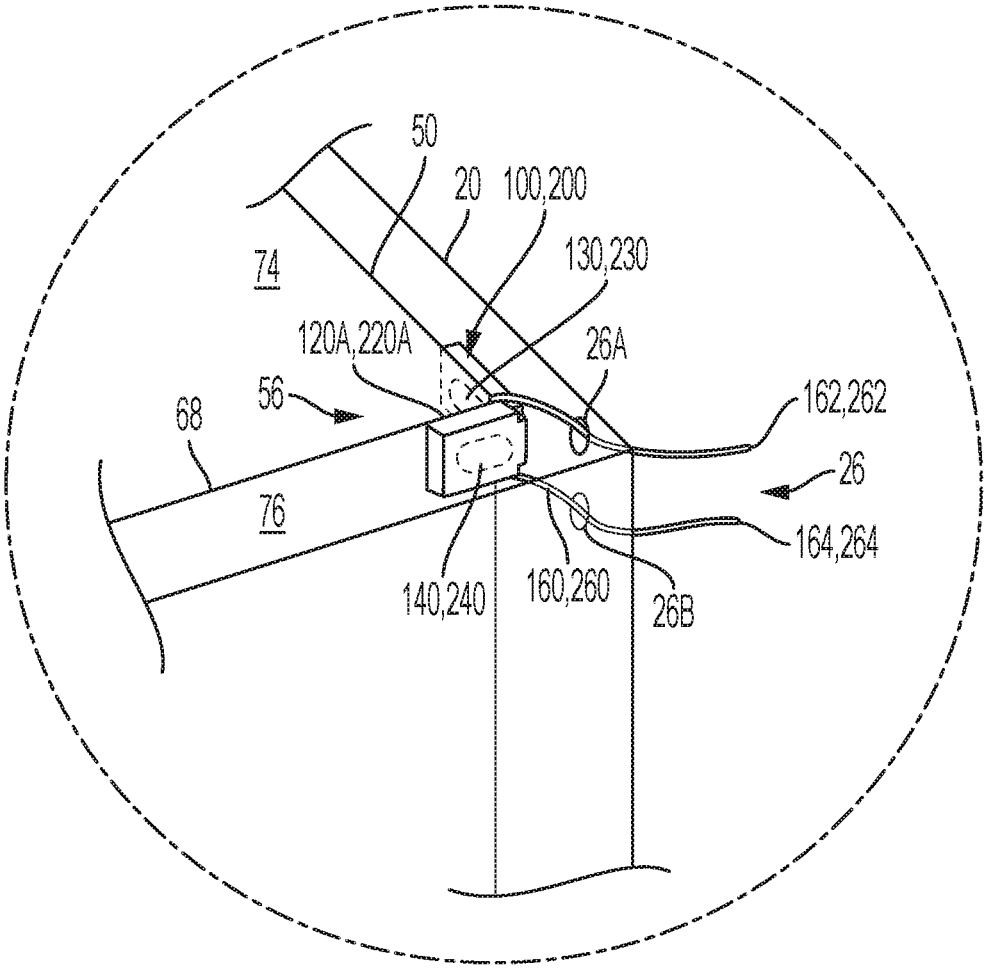
FIG. 6 is a detail view of the bag assembly taken generally along detail 6 in FIG. 1; and, FIG. 7 is a perspective view of a roll including a plurality of tie attachment assemblies arranged thereon.

FIG. 6 is a detail view of bag assembly 10 taken generally along detail 6 in FIG. 1. As shown, tie attachment assembly 100, 200 is secured to corner 56 of inner bag 50. Fold line L is positioned on corner 56 with cutout 140, 240 being secured to side 76 and cutout 130, 230 being secured to side

74. Tie 160, 260 is thus trapped between surface 120A, 220A of tie attachment assembly 100, 200 and outer surface of inner liner 50. End 162, 262 extends through hole 26A and end 164, 264 extends through hole 26B. The ends are then tied together about to outside of outer bag 20 (not shown) thereby securing corner 56 of inner bag 50 to corner 26 of outer bag 20.

Figure 7:
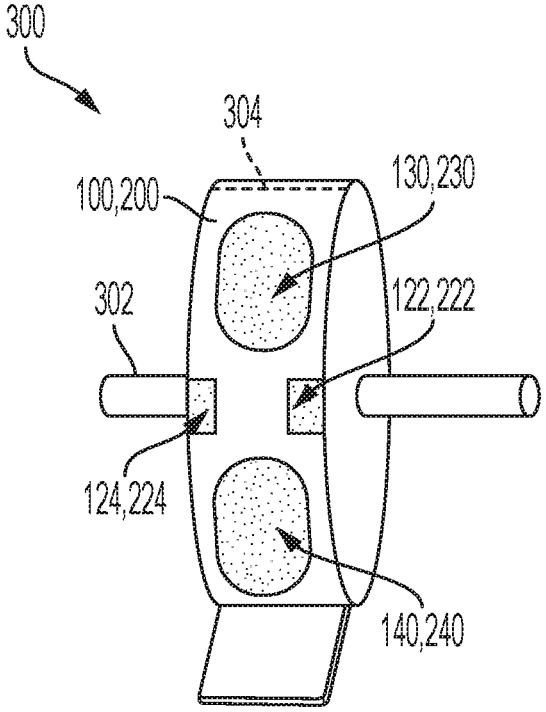

FIG. 7 is a perspective view of roll 300 including a plurality of tie attachment assemblies 100, 200 arranged thereon. As shown, tie attachment assemblies 100, 200 can be manufactured as roll 300. Roll 300 comprises a plurality of tie attachment assemblies 100, 200. Roll 300 may comprise perforations 304. In some embodiments, perforations are arranged between every set of two cutouts such that a user can easily tear away one single tie attachment assembly 100, 200 from roll 300. Roll 300 may be arranged on shaft 302 for easy dispensing. In some embodiments, a cutting device is set to cut roll 300 between every set of two cutouts. Roll 300 allows tie attachment assemblies 100, 200 to be easily assembled to inner liner 50 on site. It should be appreciated that tie attachment assembly 100, 200 may further comprise an additional non-stick layer arranged over the top of layer 120, 220 to protect the exposed adhesive sections of layer 110, 210. Additionally, and as previously discussed, surface 110B, 210B may comprise a non-stick layer such that, in roll 300, tie attachment assembly 100, 200 is easily peelable from the rest of roll 300.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Bag assembly
20 Outer bag
22 Corner
22A Hole
22B Hole
24 Corner
24A Hole
24B Hole
26 Corner
26A Hole
26B Hole
28 Corner
28A Hole
28B Hole
30 Corner
30A Hole
30B Hole
32 Corner
32A Hole
32B Hole
34 Corner
34A Hole
34B Hole
36 Corner
36A Hole
36B Hole
50 Inner liner
52 Corner
54 Corner
56 Corner
58 Corner
60 Corner
62 Corner
64 Corner
66 Corner
68 Top Edge
70 Bottom edge
72 Side
74 Side
76 Side
78 Side
80 Side
100 Tie attachment assembly
110 Layer
110A Surface
110B Surface
120 Layer
120A Surface
120B Surface
122 Cutout
124 Cutout
130 Cutout
132A Section
132B Section
132C Section
132D Section
134A Section
134B Section
134C Section
134D Section
136 Section
140 Cutout
142A Section
142B Section
142C Section
142D Section
144A Section
144B Section
144C Section
144D Section
146 Section
160 Tie
162 End
164 End
200 Tie attachment assembly
210 Layer
210A Surface
210B Surface
220 Layer
220A Surface
220B Surface
222 Cutout
224 Cutout
230 Cutout
240 Cutout
260 Tie
262 End
264 End
300 Roll
302 Shaft
304 Perforation
W1 Width or thickness
W2 Width or thickness
W3 Width or thickness
W4 Width or thickness
W5 Width or thickness W6 Width or thickness
L1 Length
L2 Length
D1 Distance
D2 Distance
D3 Distance
D4 Distance
R1 Radius
R2 Radius
R3 Radius
R4 Radius
L Line

What is claimed is:

1. A bag assembly, comprising: an inner liner including a first corner formed from a first side and a second side; a tie attachment assembly, including: a first layer including a first surface and a second surface, the first surface comprising an adhesive and arranged to be secured to the inner liner; a second layer, including: a third surface arranged to abut against the inner liner proximate the first corner; a fourth surface connected to the first surface; a first cutout operatively arranged to expose the adhesive to the inner liner; and, a second cutout; and, a tie arranged between the third surface and the inner liner.

2. The tie attachment assembly as recited in claim 1, wherein the second layer further comprises a third cutout operatively arranged to expose the adhesive of the first surface for engagement with the tie.

3. The tie attachment assembly as recited in claim 1, further comprising a fold line, wherein:

the first cutout is arranged on a first side of the fold line;

the second cutout is arranged on a second side of the fold line, opposite the first side; and, the tie is arranged proximate the fold line.

4. The tie attachment assembly as recited in claim 1, wherein the first cutout comprises:

a radially innermost section having a first width;

a radially intermediate section having a second width; and, a radially outermost section having a third width.

5. The tie attachment assembly as recited in claim 4, wherein the radially innermost section, the radially intermediate section, and the radially outermost section are separated from each other.

6. The tie attachment assembly as recited in claim 4, wherein the first width is greater than the second width and the second width is greater than the third width.

7. The tie attachment assembly as recited in claim 1, further comprising an outer bag comprising a second corner, wherein the tie is arranged to be connected to the second corner to connect the inner liner to the outer bag.

8. The tie attachment assembly as recited in claim 7, wherein the second corner comprises at least one hole, and the tie extends through the at least one hole to connect the tie to the outer bag.

* * * * *